US007511680B2

(12) United States Patent
Shtrom et al.

(10) Patent No.: US 7,511,680 B2
(45) **Date of Patent: *Mar. 31, 2009**

(54) MINIMIZED ANTENNA APPARATUS WITH SELECTABLE ELEMENTS

(75) Inventors: Victor Shtrom, Mountain View, CA (US); William S. Kish, Mountain View, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/924,082

(22) Filed: Oct. 25, 2007

(65) Prior Publication Data

US 2008/0136725 A1 Jun. 12, 2008

Related U.S. Application Data

(63) Continuation of application No. 11/041,145, filed on Jan. 21, 2005, now Pat. No. 7,362,280.

(60) Provisional application No. 60/602,711, filed on Aug. 18, 2004, provisional application No. 60/603,157, filed on Aug. 18, 2004.

(51) Int. Cl.
*H01Q 9/28* (2006.01)
*H01Q 1/48* (2006.01)

(52) U.S. Cl. ..... 343/795; 343/846

(58) Field of Classification Search ..... 343/700 MS, 343/793, 795, 846, 876
See application file for complete search history.

(56) References Cited

U.S. PATENT DOCUMENTS 723,188 A 3/1903 Tesla
725,605 A 4/1903 Tesla
1,869,659 A 8/1932 Broertjes (Continued)

FOREIGN PATENT DOCUMENTS

EP 0 534 612 3/1993

(Continued)

OTHER PUBLICATIONS

Ken Tang, et al., "MAC Layer Broadcast Support in 802.11 Wireless Networks," Computer Science Department, University of California, Los Angeles, 2000 IEEE, pp. 544-548.

(Continued)

*Primary Examiner*—Shih-Chao Chen
(74) *Attorney, Agent, or Firm*—Carr & Ferrell LLP

(57) ABSTRACT

A system and method for a wireless link to a remote receiver includes a communication device for generating RF and an antenna apparatus for transmitting the RF. The antenna apparatus comprises a plurality of substantially coplanar modified dipoles. Each modified dipole provides gain with respect to isotropic and a horizontally polarized directional radiation pattern. Further, each modified dipole has one or more loading structures configured to decrease the footprint (i.e., the physical dimension) of the modified dipole and minimize the size of the antenna apparatus. The modified dipoles may be electrically switched to result in various radiation patterns. With multiple of the plurality of modified dipoles active, the antenna apparatus may form an omnidirectional horizontally polarized radiation pattern. One or more directors may be included to concentrate the radiation pattern. The antenna apparatus may be conformally mounted to a housing containing the communication device and the antenna apparatus.

20 Claims, 5 Drawing Sheets

U.S. PATENT DOCUMENTS

| | | | | |
|---|---|---|---|---|
| 2,292,387 | A | | 8/1942 | Markey et al. |
| 3,488,445 | A | | 1/1970 | Chang |
| 3,568,105 | A | | 3/1971 | Felsenheld |
| 3,721,990 | A | * | 3/1973 | Gibson et al. ..... 343/726 |
| 3,967,067 | A | | 6/1976 | Potter |
| 3,982,214 | A | | 9/1976 | Burns |
| 3,991,273 | A | | 11/1976 | Mathes |
| 4,001,734 | A | | 1/1977 | Burns |
| 4,176,356 | A | | 11/1979 | Foster et al. |
| 4,193,077 | A | | 3/1980 | Greenberg et al. |
| 4,305,052 | A | | 12/1981 | Baril et al. |
| 4,554,554 | A | | 11/1985 | Olesen et al. |
| 4,733,203 | A | | 3/1988 | Ayasli |
| 4,800,393 | A | * | 1/1989 | Edward et al. ..... 343/821 |
| 4,814,777 | A | | 3/1989 | Monser |
| 5,063,574 | A | | 11/1991 | Moose |
| 5,173,711 | A | | 12/1992 | Takeuchi et al. |
| 5,208,564 | A | | 5/1993 | Burns et al. |
| 5,220,340 | A | | 6/1993 | Shafai |
| 5,282,222 | A | | 1/1994 | Fattouche et al. |
| 5,291,289 | A | | 3/1994 | Hulyalkar et al. |
| 5,311,550 | A | | 5/1994 | Fouche et al. |
| 5,532,708 | A | | 7/1996 | Krenz et al. |
| 5,559,800 | A | | 9/1996 | Mousseau et al. |
| 5,754,145 | A | | 5/1998 | Evans |
| 5,767,755 | A | | 6/1998 | Kim et al. |
| 5,767,809 | A | | 6/1998 | Chuang et al. |
| 5,786,793 | A | | 7/1998 | Maeda et al. |
| 5,802,312 | A | | 9/1998 | Lazaridis et al. |
| 5,964,830 | A | | 10/1999 | Durrett |
| 5,990,838 | A | | 11/1999 | Burns et al. |
| 6,031,503 | A | | 2/2000 | Preiss, II et al. |
| 6,034,638 | A | | 3/2000 | Thiel et al. |
| 6,052,093 | A | | 4/2000 | Yao et al. |
| 6,091,364 | A | | 7/2000 | Murakami et al. |
| 6,094,177 | A | | 7/2000 | Yamamoto |
| 6,097,347 | A | | 8/2000 | Duan et al. |
| 6,104,356 | A | | 8/2000 | Hikuma et al. |
| 6,169,523 | B1 | | 1/2001 | Ploussios |
| 6,266,528 | B1 | | 7/2001 | Farzaneh |
| 6,292,153 | B1 | | 9/2001 | Aiello et al. |
| 6,307,524 | B1 | | 10/2001 | Britain |
| 6,317,599 | B1 | | 11/2001 | Rappaport et al. |
| 6,323,810 | B1 | | 11/2001 | Poilasne et al. |
| 6,326,922 | B1 | | 12/2001 | Hegendoerfer |
| 6,337,628 | B2 | | 1/2002 | Campana, Jr. |
| 6,337,668 | B1 | | 1/2002 | Ito et al. |
| 6,339,404 | B1 | | 1/2002 | Johnson et al. |
| 6,345,043 | B1 | | 2/2002 | Hsu |
| 6,356,242 | B1 | | 3/2002 | Ploussios |
| 6,356,243 | B1 | | 3/2002 | Schneider et al. |
| 6,356,905 | B1 | | 3/2002 | Gershman et al. |
| 6,377,227 | B1 | | 4/2002 | Zhu et al. |
| 6,392,610 | B1 | | 5/2002 | Braun et al. |
| 6,404,386 | B1 | | 6/2002 | Proctor, Jr. et al. |
| 6,407,719 | B1 | | 6/2002 | Ohira et al. |
| RE37,802 | E | | 7/2002 | Fattouche et al. |
| 6,424,311 | B1 | | 7/2002 | Tsai et al. |
| 6,442,507 | B1 | | 8/2002 | Skidmore et al. |
| 6,445,688 | B1 | | 9/2002 | Garces et al. |
| 6,456,242 | B1 | | 9/2002 | Crawford |
| 6,493,679 | B1 | | 12/2002 | Rappaport et al. |
| 6,496,083 | B1 | | 12/2002 | Kushitani et al. |
| 6,498,589 | B1 | | 12/2002 | Horii |
| 6,499,006 | B1 | | 12/2002 | Rappaport et al. |
| 6,507,321 | B2 | | 1/2003 | Oberschmidt et al. |
| 6,531,985 | B1 | | 3/2003 | Jones et al. |
| 6,583,765 | B1 | | 6/2003 | Schamberger et al. |
| 6,586,786 | B2 | | 7/2003 | Kitazawa et al. |
| 6,611,230 | B2 | | 8/2003 | Phelan |
| 6,625,454 | B1 | | 9/2003 | Rappaport et al. |
| 6,633,206 | B1 | | 10/2003 | Kato |
| 6,642,889 | B1 | | 11/2003 | McGrath |
| 6,674,459 | B2 | | 1/2004 | Ben-Shachar et al. |
| 6,701,522 | B1 | | 3/2004 | Rubin et al. |
| 6,725,281 | B1 | | 4/2004 | Zintel et al. |
| 6,753,814 | B2 | | 6/2004 | Killen et al. |
| 6,762,723 | B2 | | 7/2004 | Nallo et al. |
| 6,779,004 | B1 | | 8/2004 | Zintel |
| 6,819,287 | B2 | | 11/2004 | Sullivan et al. |
| 6,839,038 | B2 | | 1/2005 | Weinstein |
| 6,859,176 | B2 | | 2/2005 | Choi |
| 6,859,182 | B2 | | 2/2005 | Horii |
| 6,876,280 | B2 | | 4/2005 | Nakano |
| 6,876,836 | B2 | | 4/2005 | Lin et al. |
| 6,888,504 | B2 | | 5/2005 | Chiang et al. |
| 6,888,893 | B2 | | 5/2005 | Li et al. |
| 6,892,230 | B1 | | 5/2005 | Gu et al. |
| 6,903,686 | B2 | | 6/2005 | Vance et al. |
| 6,906,678 | B2 | | 6/2005 | Chen |
| 6,910,068 | B2 | | 6/2005 | Zintel et al. |
| 6,914,581 | B1 | | 7/2005 | Popek |
| 6,924,768 | B2 | | 8/2005 | Wu et al. |
| 6,931,429 | B2 | | 8/2005 | Gouge et al. |
| 6,941,143 | B2 | | 9/2005 | Mathur |
| 6,943,749 | B2 | | 9/2005 | Paun |
| 6,950,019 | B2 | | 9/2005 | Bellone et al. |
| 6,950,069 | B2 | | 9/2005 | Gaucher et al. |
| 6,961,028 | B2 | | 11/2005 | Joy et al. |
| 6,965,353 | B2 | | 11/2005 | Shirosaka et al. |
| 6,973,622 | B1 | | 12/2005 | Rappaport et al. |
| 6,975,834 | B1 | | 12/2005 | Forster |
| 6,980,782 | B1 | | 12/2005 | Braun et al. |
| 7,023,909 | B1 | | 4/2006 | Adams et al. |
| 7,034,769 | B2 | | 4/2006 | Surducan et al. |
| 7,034,770 | B2 | | 4/2006 | Yang et al. |
| 7,043,277 | B1 | | 5/2006 | Pfister |
| 7,050,809 | B2 | | 5/2006 | Lim |
| 7,053,844 | B2 | | 5/2006 | Gaucher et al. |
| 7,064,717 | B2 | | 6/2006 | Kaluzni et al. |
| 7,085,814 | B1 | | 8/2006 | Gandhi et al. |
| 7,088,299 | B2 | | 8/2006 | Siegler et al. |
| 7,089,307 | B2 | | 8/2006 | Zintel et al. |
| 7,130,895 | B2 | | 10/2006 | Zintel et al. |
| 7,148,846 | B2 | * | 12/2006 | Qi et al. ..... 343/700 MS |
| 7,171,475 | B2 | | 1/2007 | Weisman et al. |
| 7,277,063 | B2 | | 10/2007 | Shirosaka et al. |
| 7,312,762 | B2 | | 12/2007 | Puente Ballarda et al. |
| 7,319,432 | B2 | | 1/2008 | Andersson |
| 2001/0046848 | A1 | | 11/2001 | Kenkel |
| 2002/0031130 | A1 | | 3/2002 | Tsuchiya et al. |
| 2002/0047800 | A1 | | 4/2002 | Proctor, Jr. et al. |
| 2002/0080767 | A1 | | 6/2002 | Lee |
| 2002/0084942 | A1 | | 7/2002 | Tsai et al. |
| 2002/0105471 | A1 | | 8/2002 | Kojima et al. |
| 2002/0112058 | A1 | | 8/2002 | Weisman et al. |
| 2002/0158798 | A1 | | 10/2002 | Chiang et al. |
| 2002/0170064 | A1 | | 11/2002 | Monroe et al. |
| 2003/0026240 | A1 | | 2/2003 | Eyuboglu et al. |
| 2003/0030588 | A1 | | 2/2003 | Kalis et al. |
| 2003/0063591 | A1 | | 4/2003 | Leung et al. |
| 2003/0122714 | A1 | | 7/2003 | Wannagot et al. |
| 2003/0169330 | A1 | | 9/2003 | Ben-Shachar et al. |
| 2003/0184490 | A1 | | 10/2003 | Raiman et al. |
| 2003/0189514 | A1 | | 10/2003 | Miyano et al. |
| 2003/0189521 | A1 | | 10/2003 | Yamamoto et al. |
| 2003/0189523 | A1 | | 10/2003 | Ojantakanen et al. |
| 2003/0210207 | A1 | | 11/2003 | Suh et al. |
| 2003/0227414 | A1 | | 12/2003 | Saliga et al. |
| 2004/0014432 | A1 | | 1/2004 | Boyle |
| 2004/0017310 | A1 | | 1/2004 | Runkle et al. |
| 2004/0017860 | A1 | | 1/2004 | Liu |
| 2004/0027291 | A1 | | 2/2004 | Zhang et al. |
| 2004/0027304 | A1 | | 2/2004 | Chiang et al. |

| | | | |
|---|---|---|---|
| 2004/0032378 | A1 | 2/2004 | Volman et al. |
| 2004/0036651 | A1 | 2/2004 | Toda |
| 2004/0036654 | A1 | 2/2004 | Hsieh |
| 2004/0041732 | A1 | 3/2004 | Aikawa et al. |
| 2004/0048593 | A1 | 3/2004 | Sano |
| 2004/0058690 | A1 | 3/2004 | Ratzel et al. |
| 2004/0061653 | A1 | 4/2004 | Webb et al. |
| 2004/0070543 | A1 | 4/2004 | Masaki |
| 2004/0080455 | A1 | 4/2004 | Lee |
| 2004/0095278 | A1 | 5/2004 | Kanemoto et al. |
| 2004/0114535 | A1 | 6/2004 | Hoffmann et al. |
| 2004/0125777 | A1 | 7/2004 | Doyle et al. |
| 2004/0145528 | A1 | 7/2004 | Mukai et al. |
| 2004/0160376 | A1 | 8/2004 | Hornsby et al. |
| 2004/0190477 | A1 | 9/2004 | Olson et al. |
| 2004/0203347 | A1 | 10/2004 | Nguyen |
| 2004/0260800 | A1 | 12/2004 | Gu et al. |
| 2005/0022210 | A1 | 1/2005 | Zintel et al. |
| 2005/0041739 | A1 | 2/2005 | Li et al. |
| 2005/0042988 | A1 | 2/2005 | Hoek et al. |
| 2005/0048934 | A1 | 3/2005 | Rawnick et al. |
| 2005/0074108 | A1 | 4/2005 | Zintel et al. |
| 2005/0097503 | A1 | 5/2005 | Zintel et al. |
| 2005/0128983 | A1 | 6/2005 | Kim et al. |
| 2005/0135480 | A1 | 6/2005 | Li et al. |
| 2005/0138137 | A1 | 6/2005 | Encarnacion et al. |
| 2005/0138193 | A1 | 6/2005 | Encarnacion et al. |
| 2005/0146475 | A1 | 7/2005 | Bettner et al. |
| 2005/0180381 | A1 | 8/2005 | Retzer et al. |
| 2005/0188193 | A1 | 8/2005 | Kuehnel et al. |
| 2005/0240665 | A1 | 10/2005 | Gu et al. |
| 2005/0267935 | A1 | 12/2005 | Ghandi et al. |
| 2006/0094371 | A1 | 5/2006 | Nguyen |
| 2006/0098607 | A1 | 5/2006 | Zeng et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184661 | A1 | 8/2006 | Weisman et al. |
| 2006/0184693 | A1 | 8/2006 | Rao et al. |
| 2006/0187660 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227761 | A1 | 10/2006 | Scott, III et al. |
| 2006/0239369 | A1 | 10/2006 | Lee |
| 2006/0262015 | A1 | 11/2006 | Thornell-Pers et al. |
| 2006/0291434 | A1 | 12/2006 | Gu et al. |
| 2007/0027622 | A1 | 2/2007 | Cleron et al. |
| 2007/0135167 | A1 | 6/2007 | Liu |

FOREIGN PATENT DOCUMENTS

| | | |
|---|---|---|
| EP | 1 376 920 | 6/2002 |
| EP | 1 315 311 | 5/2003 |
| EP | 1 450 521 | 8/2004 |
| EP | 1 608 108 | 12/2005 |
| JP | 2008/088633 | 2/1996 |
| JP | 2001/057560 | 2/2002 |
| JP | 2005/354249 | 12/2005 |
| JP | 2006/060408 | 3/2006 |
| WO | WO 90/04893 | 5/1990 |
| WO | WO 02/25967 | 3/2002 |
| WO | WO 03/079484 | 9/2003 |

OTHER PUBLICATIONS

Ken Tang, et al., "MAC Reliable Broadcast in Ad Hoc Networks," Computer Science Department, University of California, Los Angeles, 2001 IEEE, pp. 1008-1013.

Vincent D. Park, et al., "A Performance Comparison of the Temporally-Ordered Routing Algorithm and Ideal Link-State Routing," IEEE, Jul. 1998, pp. 592-598.

Ian F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology, no date.

Dell Inc., "How Much Broadcast and Multicast Traffic Should I Allow in My Network," PowerConnect Application Note #5, Nov. 2003.

Toskala, Antti, "Enhancement of Broadcast and Introduction of Multicast Capabilities in RAN," Nokia Networks, Palm Springs, California, Mar. 13-16, 2001.

Microsoft Corporation, "IEEE 802.11 Networks and Windows XP," Windows Hardware Developer Central, Dec. 4, 2001.

Festag, Andreas, "What is Mombasa?" Telecommunication Networks Group (TKN), Technical University of Berlin, Mar. 7, 2002.

Hewlett Packard, "HP ProCurve Networking: Enterprise Wireless LAN Networking and Mobility Solutions," 2003.

Dutta, Ashutosh et al., "MarconiNet Supporting Streaming Media Over Localized Wireless Multicast," Proc. of the 2d Int'l Workshop on Mobile Commerce, 2002.

Dunkels, Adam et al., "Making TCP/IP Viable for Wireless Sensor Networks," Proc. of the 1st Euro. Workshop on Wireless Sensor Networks, Berlin, Jan. 2004.

Dunkels, Adam et al., "Connecting Wireless Sensornets with TCP/IP Networks," Proc. of the 2d Int'l Conf. on Wired Networks, Frankfurt, Feb. 2004.

Cisco Systems, "Cisco Aironet Access Point Software Configuration Guide: Configuring Filters and Quality of Service," Aug. 2003.

Hirayama, Koji et al., "Next-Generation Mobile-Access IP Network," Hitachi Review vol. 49, No. 4, 2000.

Pat Calhoun et al., "802.11r strengthens wireless voice," Technology Update, Network World, Aug. 22, 2005, http://www.networkworld.com/news/tech/2005/082208techupdate.html.

Areg Alimian et al., "Analysis of Roaming Techniques," doc.:IEEE 802.11-04/0377r1, Submission, Mar. 2004.

Information Society Technologies Ultrawaves, "System Concept/Architecture Design and Communication Stack Requirement Document," Feb. 23, 2004.

Golmie, Nada, "Coexistence in Wireless Networks: Challenges and System-Level Solutions in the Unlicensed Bands," Cambridge University Press, 2006.

Mawa, Rakesh, "Power Control in 3G Systems," Hughes Systique Corporation, Jun. 28, 2006.

Wennstrom, Mattias et al., "Transmit Antenna Diversity in Ricean Fading Mimo Channels with Co-Channel Interference," 2001.

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

"Authorization of spread spectrum and other wideband emissions not presently for in the FCC Rules and Regulations," Before the Federal Communications Commission, FCC 81-289, 87 F.C.C.2d 876, Gen Docket No. 81-413, Jun. 30, 1981.

RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.

Chang, Robert W., "Synthesis of Band-Limited Orthogonal Signals for Multichannel Data Transmission," The Bell System Technical Journal, Dec. 1966, pp. 1775-1796.

Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.

Saltzberg, Burton R., "Performance of an Efficient Parallel Data Transmission System," IEEE Transactions on Communication Technology, vol. Com-15, No. 6, Dec. 1967, pp. 805-811.

Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.

Moose, Paul H., "Differential Modulation and Demodulation of Multi-Frequency Digital Communications Signals," 1990 IEEE,CH2831-6/90/0000-0273.

Casas, Eduardo F., et al., "OFDM for Data Communication Over Mobile Radio FM Channels-Part I: Analysis and Experimental Results," IEEE Transactions on Communications, vol. 39, No. 5, May 1991, pp. 783-793.
Casas, Eduardo F., et al., "OFDM for Data Communication over Mobile Radio FM Channels; Part II: Performance Improvement," Department of Electrical Engineering, University of British Columbia, no date.
Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Alard, M., et al., "Principles of Modulation and Channel Coding for Digital Broadcasting for Mobile Receivers," 8301 EBU Review Technical, Aug. 1987, No. 224, Brussels, Belgium.
Berenguer, Inaki, et al., "Adaptive Mimo Antenna Selection," Nov. 2003.
Guar, Sudhanshu, et al., "Transmit/Receive Antenna Selection for Mimo Systems to Improve Error Performance of Linear Receivers," School of ECE, Georgia Institute of Technology, Apr. 4, 2005.
Sadek, Mirette, et al., "Active Antenna Selection in Multiuser Mimo Communications," IEEE Transactions on Signal Processing, vol. 55, No. 4, Apr. 2007, pp. 1498-1510.
Molisch, Andreas F., et al., "Mimo Systems with Antenna Selection-an Overview," Draft, Dec. 31, 2003.
Steger, Christopher et al., "Performance of IEEE 802.11b Wireless LAN in an Emulated Mobile Channel," 2003.
Chang, Nicholas B. et al., "Optimal Channel Probing and Transmission Scheduling for Opportunistics Spectrum Access," Sep. 2007.
Chuang et al., A 2.4 GHz Polarization-diversity Planar Printed Dipole Antenna for WLAN and Wireless Communications Applications, Microwave Journal, vol. 45, No. 6, pp. 50-62 (Jun. 2002).
Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).
W.E. Doherty, Jr. et al., The Pin Diode Circuit Designer's Handbook (1998).
Varnes et al., A Switched Radial Divider for an L-Band Mobile Satellite antenna, European Microwave Conference (Oct. 1995), pp. 1037-1047.
English Translation of PCT Pub. No. WO2004/051798 (as filed U.S. Appl. No. 10/536,547).
Behdad et al., Slot Antenna Miniaturization Using Distributed Inductive Loading, Antenna and Propagation Society International Symposium, 2003 IEEE, vol. 1, pp. 308-311 (Jun. 2003).
Press Release, NetGear RangeMax(TM) Wireless Networking Solutions Incorporate Smart Mimo Technology To Eliminate Wireless Dead Spots and Take Consumers Farther, Ruckus Wireless Inc. (Mar. 7, 2005), available at http://ruckuswireless.com/press/releases/20050307.php.

* cited by examiner

MINIMIZED ANTENNA APPARATUS WITH SELECTABLE ELEMENTS

CROSS-REFERENCE TO RELATED APPLICATIONS

This application is a continuation and claims the priority benefit of U.S. patent application Ser. No. 11/041,145 filed Jan. 21, 2005 now U.S. Pat. No. 7,362,280 and entitled "System and Method for a Minimized Antenna Apparatus with Selectable Elements," which claims the priority benefit of U.S. provisional patent application No. 60/602,711 filed Aug. 18, 2004 and entitled "Planar Antenna Apparatus for Isotropic Coverage and QoS Optimization in Wireless Networks" and U.S. provisional patent application No. 60/603,157 filed Aug. 18, 2004 and entitled "Software for Controlling a Planar Antenna Apparatus for Isotropic Coverage and QoS Optimization in Wireless Networks." The disclosure of each of the aforementioned applications is incorporated by reference.

BACKGROUND OF INVENTION

1. Field of the Invention

The present invention relates generally to wireless communications, and more particularly to a system and method for a horizontally polarized antenna apparatus with selectable elements.

2. Description of the Prior Art

In communications systems, there is an ever-increasing demand for higher data throughput, and a corresponding drive to reduce interference that can disrupt data communications. For example, in an IEEE 802.11 network, an access point (i.e., base station) communicates data with one or more remote receiving nodes (e.g., a network interface card) over a wireless link. The wireless link may be susceptible to interference from other access points and stations (nodes), other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One solution for reducing interference in the wireless link between the access point and the remote receiving node is to provide several omnidirectional antennas, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link.

However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space. Typical solutions for creating horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point. Yet another problem is that the access point with the typical omnidirectional antennas is a relatively large physically, because the omnidirectional antennas extend from the housing.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another solution to reduce interference involves beam steering with an electronically controlled phased array antenna. However, the phased array antenna can be extremely expensive to manufacture. Further, the phased array antenna can require many phase tuning elements that may drift or otherwise become maladjusted.

SUMMARY OF INVENTION

In an embodiment of the presently claimed invention, an antenna apparatus is provided. The apparatus includes a substrate having a first side and a second side, the second side of the being substantially parallel to the first side. Active antenna elements on one side of the substrate are configured such that they may be coupled to a radio frequency communication device to form a first part of a modified dipole. A ground component on the second side of the substrate forms the second part of the modified dipole. Each modified dipole includes a loading structure that changes the resonance of the dipole. Through this modification, the overall dimension of the dipole may be reduced compared to the dimensions of a dipole absent such loading structures.

In a further claimed embodiment, an antenna element apparatus is disclosed. The apparatus includes substantially coplanar modified dipoles, each having one or more loading structures that change the resonance of the substantially coplanar modified dipoles. As a result, the dimension of the substantially coplanar modified dipoles may be reduced in comparison to a substantially coplanar modified dipole without corresponding loading structures. The apparatus further includes one or more directors configured to concentrate the radiation pattern of one or more of the substantially coplanar modified dipoles.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

A system for a wireless (i.e., radio frequency or RF) link to a remote receiving device includes a communication device for generating an RF signal and an antenna apparatus for transmitting and/or receiving the RF signal. The antenna apparatus comprises a plurality of substantially coplanar modified dipoles. Each modified dipole provides gain (with respect to isotropic) and a horizontally polarized directional radiation pattern. Further, each modified dipole has one or more loading structures configured to decrease the footprint (i.e., the physical dimension) of the modified dipole and minimize the size of the antenna apparatus. With all or a portion of the plurality of modified dipoles active, the antenna apparatus forms an omnidirectional horizontally polarized radiation pattern.

Advantageously, the loading structures decrease the size of the antenna apparatus, and allow the system to be made smaller. The antenna apparatus is easily manufactured from common planar substrates such as an FR4 printed circuit board (PCB). Further, the antenna apparatus may be integrated into or conformally mounted to a housing of the system, to minimize cost and size of the system, and to provide support for the antenna apparatus.

As described further herein, a further advantage is that the directional radiation pattern of the antenna apparatus is horizontally polarized, substantially in the plane of the antenna elements. Therefore, RF signal transmission indoors is enhanced as compared to a vertically polarized antenna.

In some embodiments, the modified dipoles comprise individually selectable antenna elements. In these embodiments, each antenna element may be electrically selected (e.g., switched on or off) so that the antenna apparatus may form a configurable radiation pattern. If all elements are switched on, the antenna apparatus forms an omnidirectional radiation pattern. In some embodiments, if two or more of the elements is switched on, the antenna apparatus may form a substantially omnidirectional radiation pattern. In such embodiments, the system may select a particular configuration of antenna elements that minimizes interference over the wireless link to the remote receiving device. If the wireless link experiences interference, for example due to other radio transmitting devices, or changes or disturbances in the wireless link between the system and the remote receiving device, the system may select a different configuration of selected antenna elements to change the resulting radiation pattern and minimize the interference. The system may select a configuration of selected antenna elements corresponding to a maximum gain between the system and the remote receiving device. Alternatively, the system may select a configuration of selected antenna elements corresponding to less than maximal gain, but corresponding to reduced interference in the wireless link.

Figure 1:
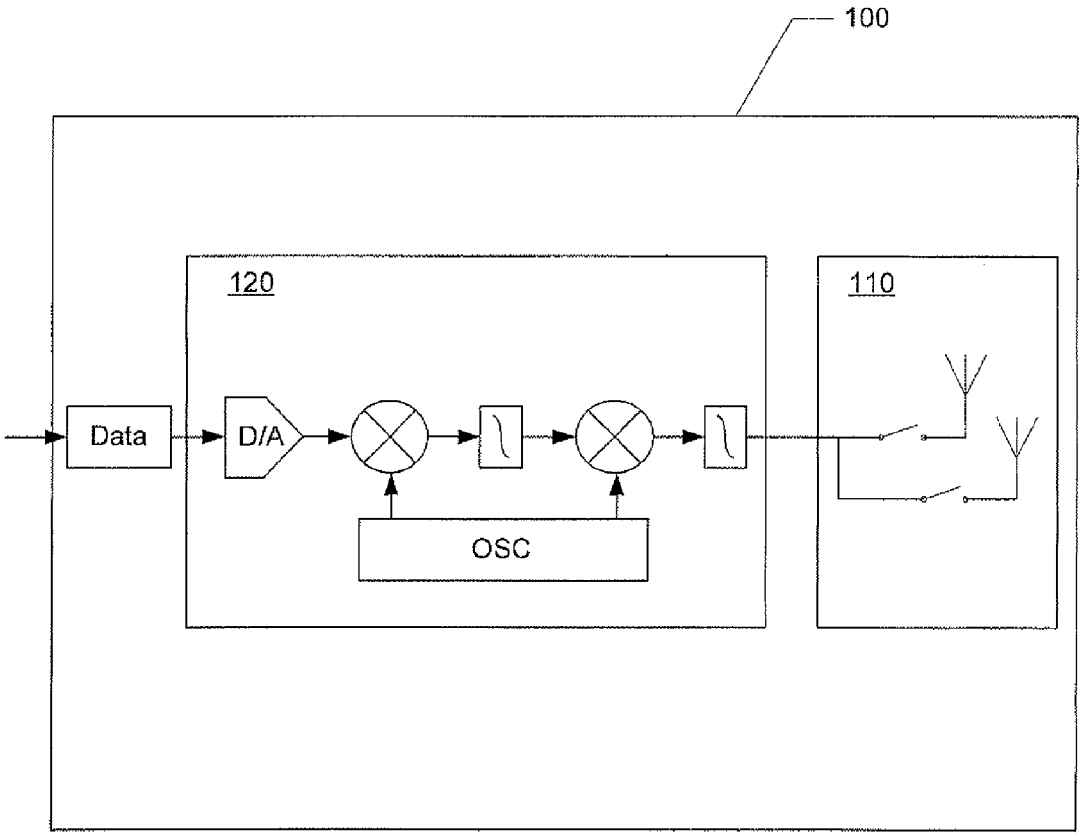
FIG. 1 illustrates a system comprising a horizontally polarized antenna apparatus with selectable elements, in one embodiment in accordance with the present invention.

FIG. 1 illustrates a system 100 comprising a horizontally polarized antenna apparatus with selectable elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, a Voice Over Internet telephone and a remote terminal such as a handheld gaming device. In some exemplary embodiments, the system 100 comprises an access point for communicating to one or more remote receiving nodes (not shown) over a wireless link, for example in an 802.11 wireless network. Typically, the system 100 may receive data from a router connected to the Internet (not shown), and the system 100 may transmit the data to one or more of the remote receiving nodes. The system 100 may also form a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the antenna apparatus, the system 100 may also receive data from the remote receiving node via the antenna apparatus.

The system 100 includes a communication device 120 (e.g., a transceiver) and an antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, for example, the communication device 120 comprises well-known circuitry for receiving data packets of video from the router and circuitry for converting the data packets into 802.11 compliant RF signals.

As described further herein, the antenna apparatus 110 comprises a plurality of modified dipoles. Each of the antenna elements provides gain (with respect to isotropic) and a horizontally polarized directional radiation pattern.

In embodiments with individually selectable antenna elements, each antenna element may be electrically selected (e.g., switched on or off) so that the antenna apparatus 110 may form a configurable radiation pattern. The antenna apparatus 110 may include an antenna element selecting device configured to selectively couple one or more of the antenna elements to the communication device 120.

Figure 2A:
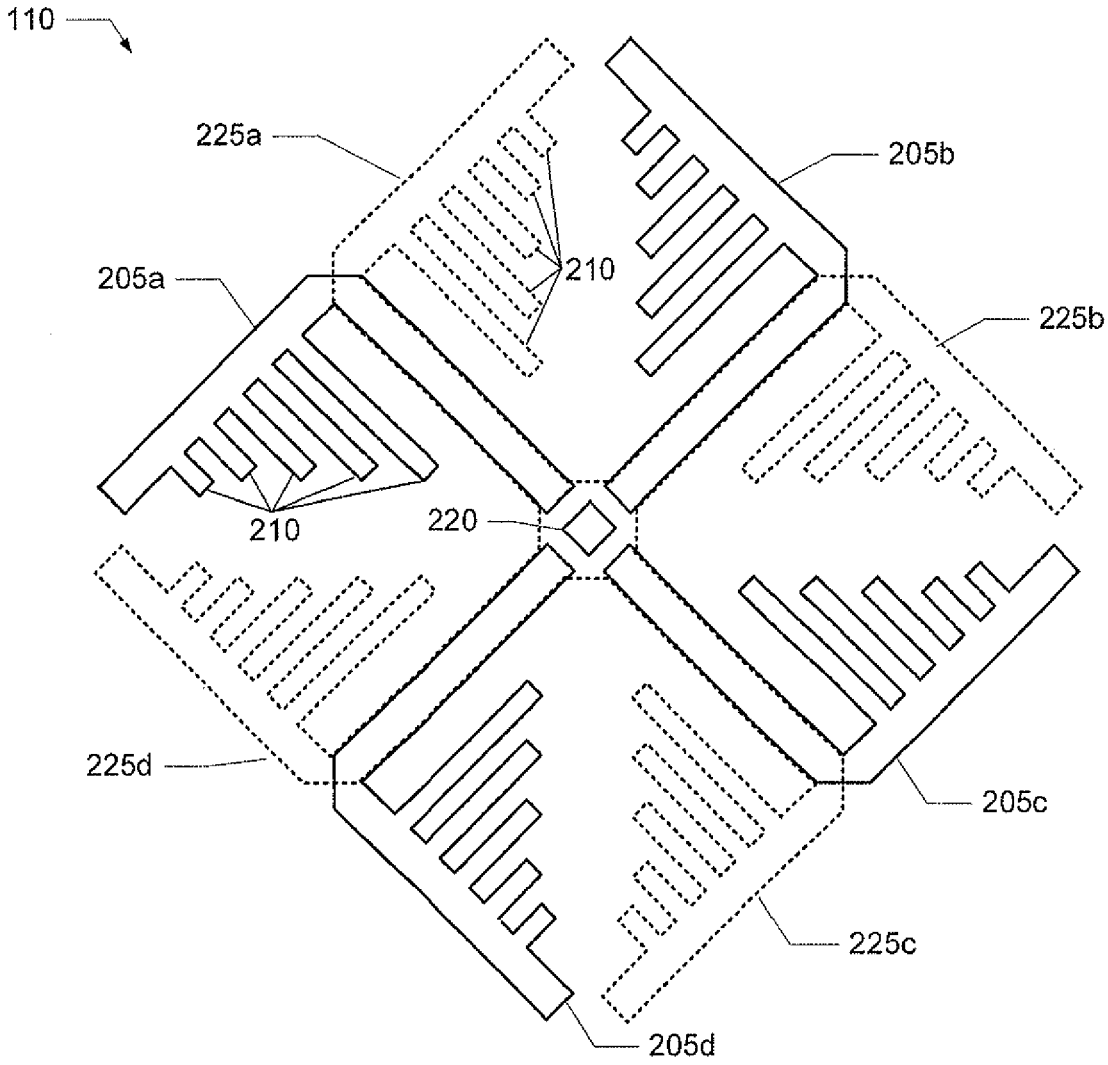
FIG. 2A illustrates the antenna apparatus of FIG. 1, in one embodiment in accordance with the present invention.

FIG. 2A illustrates the antenna apparatus 110 of FIG. 1, in one embodiment in accordance with the present invention. The antenna apparatus 110 of this embodiment includes a substrate (considered as the plane of FIG. 2A) having a first side (depicted as solid lines 205) and a second side (depicted as dashed lines 225) substantially parallel to the first side. In some embodiments, the substrate comprises a PCB such as FR4, Rogers 4003, or other dielectric material.

On the first side of the substrate, depicted by solid lines, the antenna apparatus 110 of FIG. 2A includes a radio frequency feed port 220 and four antenna elements 205*a*-205*d*. Although four modified dipoles (i.e., antenna elements) are depicted, more or fewer antenna elements are contemplated. Although the antenna elements 205*a*-205*d* of FIG. 2A are oriented substantially to edges of a square shaped substrate so as to minimize the size of the antenna apparatus 110, other shapes are contemplated. Further, although the antenna elements 205*a*-205*d* form a radially symmetrical layout about the radio frequency feed port 220, a number of non-symmetrical layouts, rectangular layouts, and layouts symmetrical in only one axis, are contemplated. Furthermore, the antenna elements 205*a*-205*d* need not be of identical dimension, although depicted as such in FIG. 2A.

On the second side of the substrate, depicted as dashed lines in FIG. 2A, the antenna apparatus 110 includes a ground component 225. It will be appreciated that a portion (e.g., the portion 225*a*) of the ground component 225 is configured to form a modified dipole in conjunction with the antenna element 205*a*. As will be apparent to one of ordinary skill, the dipole is completed for each of the antenna elements 205*a*-205*d* by respective conductive traces 225*a*-225*d* extending in mutually-opposite directions. The resultant modified dipole provides a horizontally polarized directional radiation pattern (i.e., substantially in the plane of the antenna apparatus 110), as described further with respect to FIG. 3.

To minimize or reduce the size of the antenna apparatus 110, each of the modified dipoles (e.g. the antenna element 205*a* and the portion 225*a* of the ground component 225) incorporates one or more loading structures 210. For clarity of illustration, only the loading structures 210 for the modified dipole formed from the antenna element 205*a* and the portion 225*a* are numbered in FIG. 2A. The loading structure 210 is configured to slow down electrons, changing the resonance of each modified dipole, thereby making the modified dipole electrically shorter. In other words, at a given operating frequency, providing the loading structures 210 allows the dimension of the modified dipole to be reduced. Providing the loading structures 210 for all of the modified dipoles of the antenna apparatus 110 minimizes the size of the antenna apparatus 110.

Figure 2B:
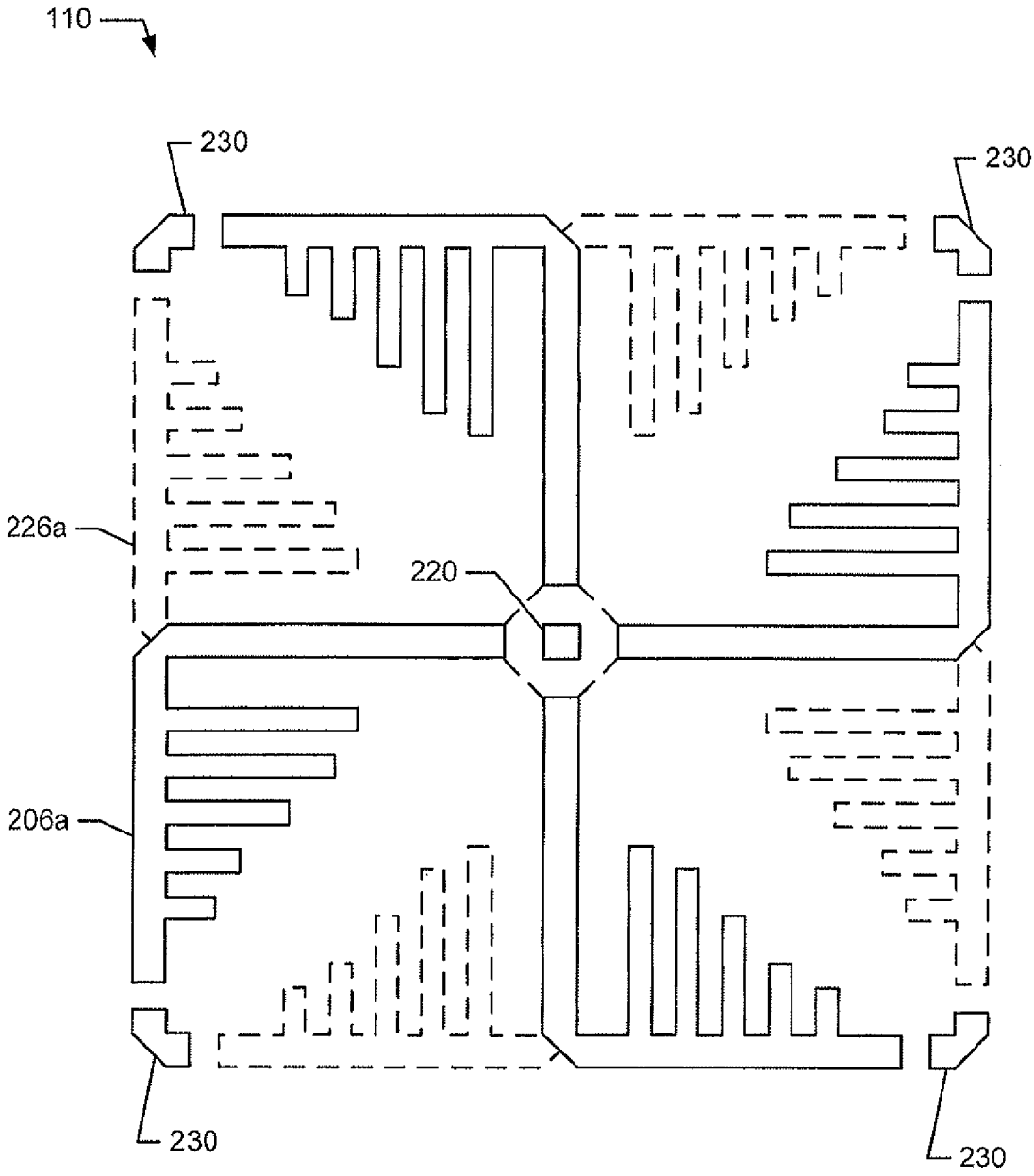
FIG. 2B illustrates the antenna apparatus of FIG. 1, in an alternative embodiment in accordance with the present invention.

FIG. 2B illustrates the antenna apparatus 110 of FIG. 1, in an alternative embodiment in accordance with the present invention. The antenna apparatus 110 of this embodiment includes one or more directors 230. The directors 230 comprise passive elements that constrain the directional radiation pattern of the modified dipoles formed by antenna elements 206*a*-206*d* in conjunction with portions 226*a*-226*d* of the ground component (only 206*a* and 226*a* labeled, for clarity). Because of the directors 230, the antenna elements 206 and the portions 226 are slightly different in configuration than the antenna elements 205 and portions 225 of FIG. 2A. In one embodiment, providing a director 230 for each of the antenna elements 206*a*-206*d* yields an additional about 1 dB of gain for each dipole. It will be appreciated that the directors 230 may be placed on either side of the substrate. It will also be appreciated that additional directors (not shown) may be included to further constrain the directional radiation pattern of one or more of the modified dipoles.

Figure 2C:
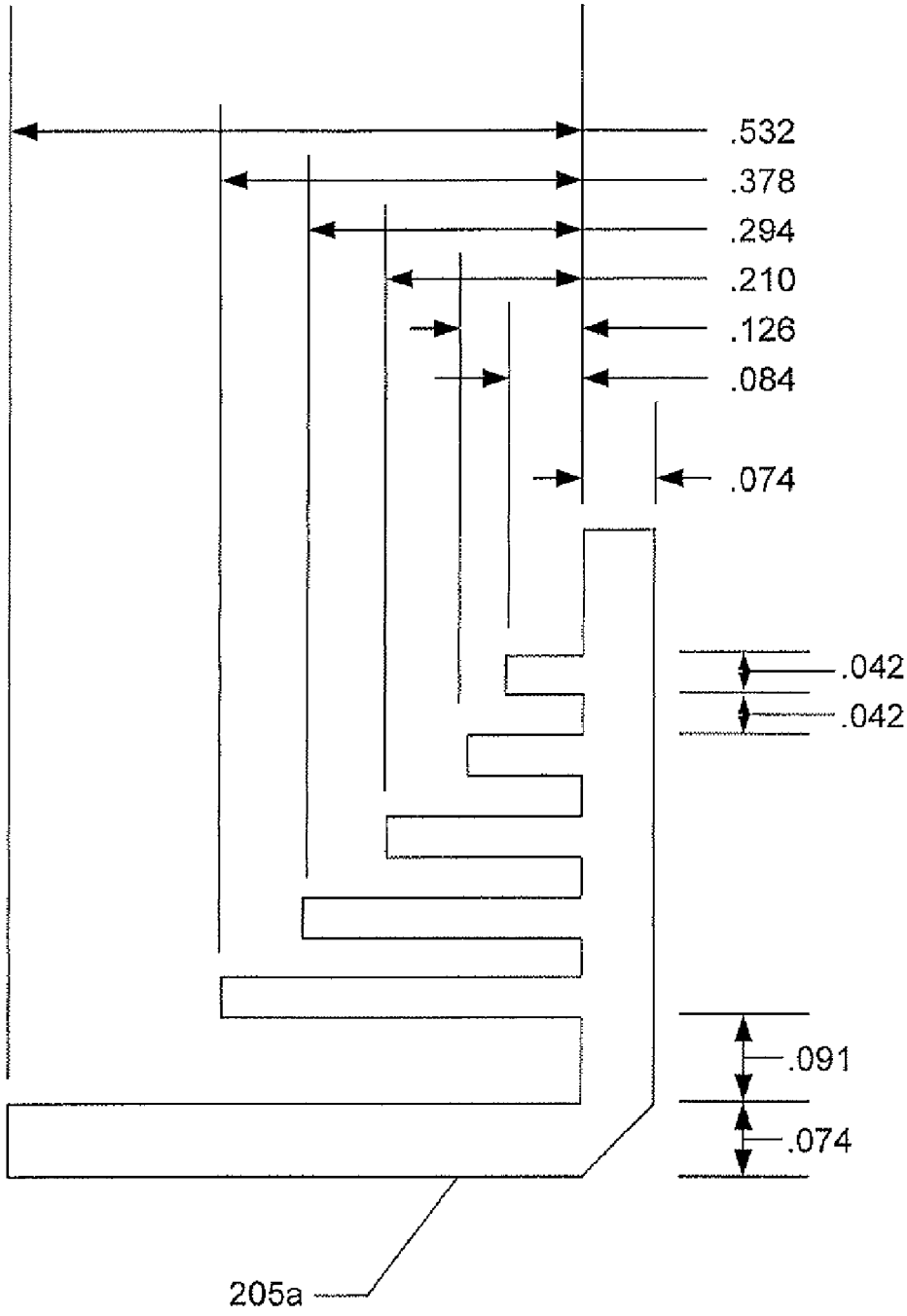
FIG. 2C illustrates dimensions for one antenna element of the antenna apparatus of FIG. 2A, in one embodiment in accordance with the present invention.

FIG. 2C illustrates dimensions for one antenna element of the antenna apparatus 110 of FIG. 2A, in one embodiment in accordance with the present invention. It will be appreciated that the dimensions of individual components of the antenna apparatus 110 (e.g., the antenna element 205*a* and the portion 225*a*) depend upon a desired operating frequency of the antenna apparatus 110. The dimensions of the individual components may be established by use of RF simulation software, such as IE3D from Zeland Software of Fremont, Calif. For example, the antenna apparatus 110 incorporating the components of dimension according to FIG. 2C is designed for operation near 2.4 GHz, based on a substrate PCB of Rogers 4003 material, but it will be appreciated by an antenna designer of ordinary skill that a different substrate having different dielectric properties, such as FR4, may require different dimensions than those shown in FIG. 2C.

Referring to FIGS. 2A and 2B, the radio frequency feed port 220 is configured to receive an RF signal from and/or transmit an RF signal to the communication device 120 of FIG. 1. In some embodiments, an antenna element selector (not shown) may be used to couple the radio frequency feed port 220 to one or more of the antenna elements 205. The antenna element selector may comprise an RF switch (not shown), such as a PIN diode, a GaAs FET, or virtually any RF switching device.

In the embodiment of FIG. 2A, the antenna element selector comprises four PIN diodes, each PIN diode connecting one of the antenna elements 205*a*-205*d* to the radio frequency feed port 220. In this embodiment, the PIN diode comprises a single-pole single-throw switch to switch each antenna element either on or off (i.e., couple or decouple each of the antenna elements 205*a*-205*d* to the radio frequency feed port 220). In one embodiment, a series of control signals (not shown) is used to bias each PIN diode. With the PIN diode forward biased and conducting a DC current, the PIN diode switch is on, and the corresponding antenna element is selected. With the diode reverse biased, the PIN diode switch is off. In this embodiment, the radio frequency feed port 220 and the PIN diodes of the antenna element selector are on the side of the substrate with the antenna elements 205*a*-205*d*, however, other embodiments separate the radio frequency feed port 220, the antenna element selector, and the antenna elements 205*a*-205*d*. In some embodiments, one or more light emitting diodes (not shown) are coupled to the antenna element selector as a visual indicator of which of the antenna elements 205*a*-205*d* is on or off. In one embodiment, a light emitting diode is placed in circuit with the PIN diode so that the light emitting diode is lit when the corresponding antenna element 205 is selected.

In some embodiments, the antenna components (e.g., the antenna elements 205*a*-205*d*, the ground component 225, and the directors 210) are formed from RF conductive material. For example, the antenna elements 205*a*-205*d* and the ground component 225 may be formed from metal or other RF conducting material. Rather than being provided on opposing sides of the substrate as shown in FIGS. 2A and 2B, each antenna element 205*a*-205*d* is coplanar with the ground component 225. In some embodiments, the antenna components may be conformally mounted to the housing of the system 100. In such embodiments, the antenna element selector comprises a separate structure (not shown) from the antenna elements 205*a*-205*d*. The antenna element selector may be mounted on a relatively small PCB, and the PCB may be electrically coupled to the antenna elements 205*a*-205*d*. In some embodiments, the switch PCB is soldered directly to the antenna elements 205*a*-205*d*.

In an exemplary embodiment for wireless LAN in accordance with the IEEE 802.11 standard, the antenna apparatus 110 is designed to operate over a frequency range of about 2.4 GHz to 2.4835 GHz. With all four antenna elements 205*a*-205*d* selected to result in an omnidirectional radiation pattern, the combined frequency response of the antenna apparatus 110 is about 90 MHz. In some embodiments, coupling more than one of the antenna elements 205*a*-205*d* to the radio frequency feed port 220 maintains a match with less than 10 dB return loss over 802.11 wireless LAN frequencies, regardless of the number of antenna elements 205*a*-205*d* that are switched on.

Figure 3:
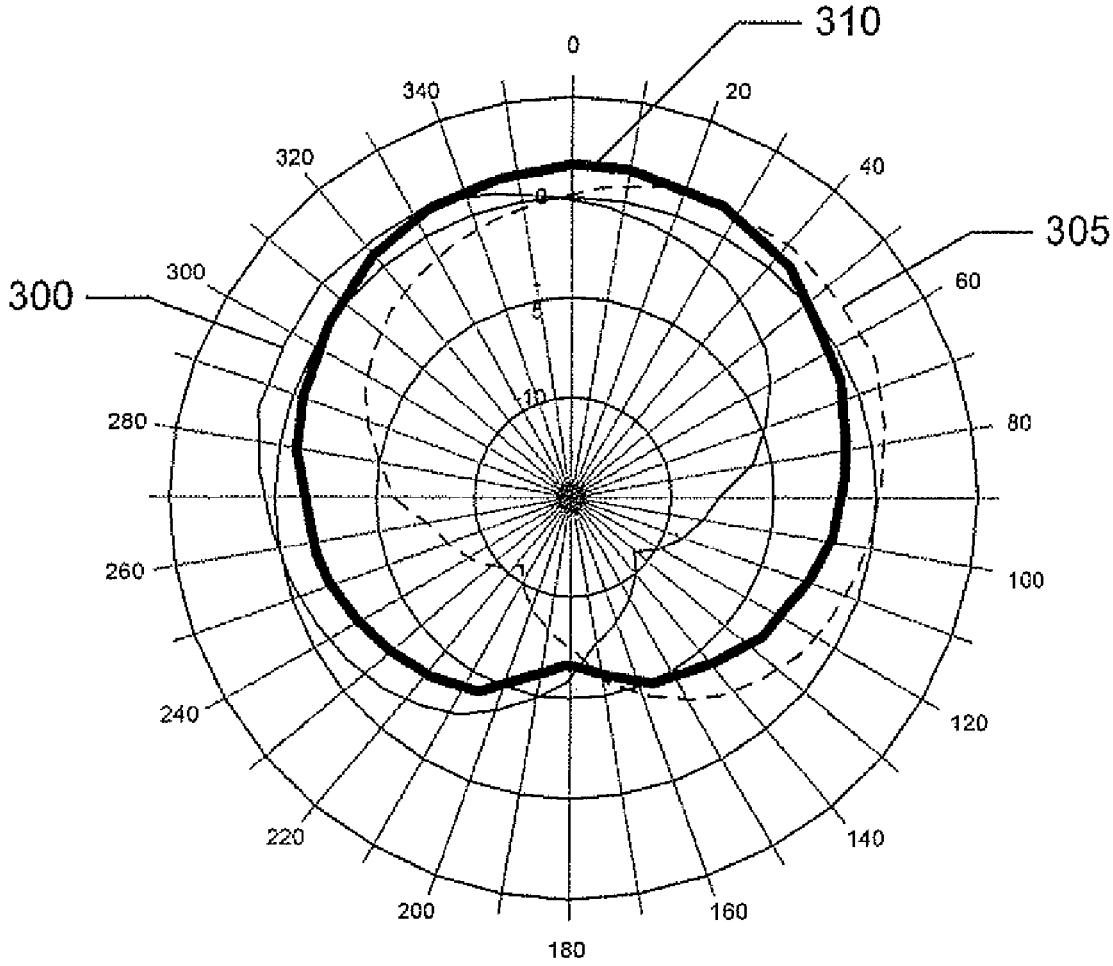
FIG. 3 illustrates various radiation patterns resulting from selecting different antenna elements of the antenna apparatus of FIG. 2, in one embodiment in accordance with the present invention.

FIG. 3 illustrates various radiation patterns resulting from selecting different antenna elements of the antenna apparatus 110 of FIG. 2A, in one embodiment in accordance with the present invention. FIG. 3 depicts the radiation pattern in azimuth (e.g., substantially in the plane of the substrate of FIG. 2A). A generally cardioid directional radiation pattern 300 results from selecting a single antenna element (e.g., the antenna element 205*a*). As shown, the antenna element 205*a* alone yields approximately 2 dBi of gain. A similar directional radiation pattern 305, offset by approximately 90 degrees from the radiation pattern 300, results from selecting an adjacent antenna element (e.g., the antenna element 205*b*). A combined radiation pattern 310 results from selecting the two adjacent antenna elements 205*a* and 205*b*. In this embodiment, enabling the two adjacent antenna elements 205*a* and 205*b* results in higher directionality in azimuth as compared to selecting either of the antenna elements 205*a* or 205*b* alone. Further, the combined radiation pattern 310 of the antenna elements 205*a* and 205*b* is offset in direction from the radiation pattern 300 of the antenna element 205*a* alone and the radiation pattern 305 of the antenna element 205*b* alone.

The radiation patterns 300, 305, and 310 of FIG. 3 in azimuth illustrate how the selectable antenna elements 205*a*-205*d* may be combined to result in various radiation patterns for the antenna apparatus 110. As shown, the combined radiation pattern 310 resulting from two or more adjacent antenna elements (e.g., the antenna element 205*a* and the antenna element 205*b*) being coupled to the radio frequency feed port is more directional than the radiation pattern of a single antenna element.

Not shown in FIG. 3 for improved legibility, is that the selectable antenna elements 205*a*-205*d* may be combined to result in a combined radiation pattern that is less directional than the radiation pattern of a single antenna element. For example, selecting all of the antenna elements 205*a*-205*d* results in a substantially omnidirectional radiation pattern that has less directionality than the directional radiation pattern of a single antenna element. Similarly, selecting two or more antenna elements (e.g., the antenna element 205*a* and the antenna element 205*c* oriented opposite from each other) may result in a substantially omnidirectional radiation pattern. In this fashion, selecting a subset of the antenna elements 205*a*-205*d*, or substantially all of the antenna elements 205*a*-205*d*, may result in a substantially omnidirectional radiation pattern for the antenna apparatus 110. Although not shown in FIG. 3, it will be appreciated that directors 230 may further constrain the directional radiation pattern of one or more of the antenna elements 205*a*-205*d* in azimuth.

FIG. 3 also shows how the antenna apparatus 110 may be advantageously configured, for example, to reduce interference in the wireless link between the system 100 of FIG. 1 and a remote receiving node. For example, if the remote receiving node is situated at zero degrees in azimuth relative to the system 100 (considered to be at the center of FIG. 3), the antenna element 205*a* corresponding to the radiation pattern 300 yields approximately the same gain in the direction of the remote receiving node as the antenna element 205*b* corresponding to the radiation pattern 305. However, as can be seen by comparing the radiation pattern 300 and the radiation pattern 305, if an interferer is situated at twenty degrees of azimuth relative to the system 100, selecting the antenna element 205*a* yields a signal strength reduction for the interferer as opposed to selecting the antenna element 205*b*. Advantageously, depending on the signal environment around the system 100, the antenna apparatus 110 may be configured to reduce interference in the wireless link between the system 100 and one or more remote receiving nodes.

Not depicted is an elevation radiation pattern for the antenna apparatus 110 of FIG. 2. The elevation radiation pattern is substantially in the plane of the antenna apparatus 110. Although not shown, it will be appreciated that the directors 230 may advantageously further constrain the radiation pattern of one or more of the antenna elements 205*a*-205*d* in elevation. For example, in some embodiments, the system 110 may be located on a floor of a building to establish a wireless local area network with one or more remote receiving nodes on the same floor. Including the directors 230 in the antenna apparatus 110 further constrains the wireless link to substantially the same floor, and minimizes interference from RF sources on other floors of the building.

An advantage of the antenna apparatus 110 is that due to the loading elements 210, the antenna apparatus 110 is reduced in size. Accordingly, the system 100 comprising the antenna apparatus 110 may be reduced in size. Another advantage is that the antenna apparatus 110 may be constructed on PCB so that the entire antenna apparatus 110 can be easily manufactured at low cost. One embodiment or layout of the antenna apparatus 110 comprises a square or rectangular shape, so that the antenna apparatus 110 is easily panelized.

A further advantage is that, in some embodiments, the antenna elements 205 are each selectable and may be switched on or off to form various combined radiation patterns for the antenna apparatus 110. For example, the system 100 communicating over the wireless link to the remote receiving node may select a particular configuration of selected antenna elements 205 that minimizes interference over the wireless link. If the wireless link experiences interference, for example due to other radio transmitting devices, or changes or disturbances in the wireless link between the system 100 and the remote receiving node, the system 100 may select a different configuration of selected antenna elements 205 to change the radiation pattern of the antenna apparatus 110 and minimize the interference in the wireless link. The system 100 may select a configuration of selected antenna elements 205 corresponding to a maximum gain between the system and the remote receiving node. Alternatively, the system may select a configuration of selected antenna elements 205 corresponding to less than maximal gain, but corresponding to reduced interference. Alternatively, all or substantially all of the antenna elements 205 may be selected to form a combined omnidirectional radiation pattern.

A further advantage of the antenna apparatus 110 is that RF signals travel better indoors with horizontally polarized signals. Typically, network interface cards (NICs) are horizontally polarized. Providing horizontally polarized signals with the antenna apparatus 110 improves interference rejection (potentially, up to 20 dB) from RF sources that use commonly-available vertically polarized antennas.

Another advantage of the system 100 is that the antenna apparatus 110 includes switching at RF as opposed to switching at baseband. Switching at RF means that the communication device 120 requires only one RF up/down converter. Switching at RF also requires a significantly simplified interface between the communication device 120 and the antenna apparatus 110. For example, the antenna apparatus 110 provides an impedance match under all configurations of selected antenna elements, regardless of which antenna elements are selected. In one embodiment, a match with less than 10 dB return loss is maintained under all configurations of selected antenna elements, over the range of frequencies of the 802.11 standard, regardless of which antenna elements are selected.

A still further advantage of the system 100 is that, in comparison for example to a phased array antenna with relatively complex phasing of elements, switching for the antenna apparatus 110 is performed to form the combined radiation pattern by merely switching antenna elements on or off. No phase variation, with attendant phase matching complexity, is required in the antenna apparatus 110.

Yet another advantage of the antenna apparatus 110 on PCB is that the minimized antenna apparatus 110 does not require a 3-dimensional manufactured structure, as would be required by a plurality of "patch" antennas needed to form an omnidirectional antenna.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. An antenna apparatus, comprising:

a substrate having a first side and a second side, wherein the second side of the substrate is substantially parallel to the first side of the substrate;

a plurality of active antenna elements on the first side of the substrate, each active antenna element configured to be selectively coupled to a radio frequency communication device; and a ground component on the second side of the substrate, the ground component and a corresponding selectively coupled active antenna element from the plurality of active antenna elements collectively having one or more loading structures, wherein the one or more loading structures change the resonance of and allow the dimension of the ground component and the corresponding selectively coupled active antenna element to be reduced in comparison to a ground component and a selectively coupled active antenna element without corresponding loading structures.

2. The antenna apparatus of claim 1, wherein coupling two or more of the plurality of active antenna elements to the radio frequency communication device produces a substantially omnidirectional radiation pattern substantially in the plane of the substrate.

3. The antenna apparatus of claim 1, further comprising an antenna element selector coupled to each of the plurality of active antenna elements, the antenna element selector configured to selectively couple each of the plurality of active antenna elements to the radio frequency communication device, wherein one or more of the antenna element selectors includes a diode.

4. The antenna apparatus of claim 3, wherein the diode is a PIN diode.

5. The antenna apparatus of claim 1, further comprising an antenna element selector coupled to each of the plurality of active antenna elements, the antenna element selector configured to selectively couple each of the plurality of active antenna elements to the radio frequency communication device, wherein one or more of the antenna element selectors includes a single pole single throw radio frequency switch.

6. The antenna apparatus of claim 1, further comprising an antenna element selector coupled to each of the plurality of active antenna elements, the antenna element selector configured to selectively couple each of the plurality of active antenna elements to the radio frequency communication device, wherein one or more of the antenna element selectors includes a gallium arsenide field-effect transistor.

7. The antenna apparatus of claim 1, wherein the substrate comprises a substantially rectangular dielectric sheet and the ground component and the corresponding selectively coupled active antenna elements are oriented substantially parallel to edges of the substrate.

8. The antenna apparatus of claim 1, further comprising one or more directors configured to concentrate a directional radiation pattern generated by the ground component and corresponding active antenna elements when selectively coupled to the radio frequency generating device.

9. The antenna apparatus of claim 1, wherein a combined radiation pattern resulting from two or more plurality of active antenna elements being selectively coupled to the radio frequency communication device is more directional than the radiation pattern of a single active antenna element.

10. The antenna apparatus of claim 1, wherein a combined radiation pattern resulting from two or more of the plurality of active antenna elements being selectively coupled to the radio frequency communication device is less directional than the radiation pattern of a single active antenna element.

11. An antenna element apparatus comprising:

a plurality of substantially coplanar sets of selectively coupled antenna elements and ground component portions having one or more loading structures, wherein the one or more loading structures change the resonance of the substantially coplanar sets of selectively coupled antenna elements and ground component portions thereby allowing the dimension of the substantially coplanar sets to be reduced in comparison to a substantially coplanar set of a selectively coupled antenna element and a ground component portion without corresponding loading structures; and one or more directors configured to concentrate the radiation pattern of one or more of the substantially coplanar sets of selectively coupled antenna elements and ground component portions having one or more loading structures.

12. The antenna apparatus of claim 11, wherein the substantially coplanar sets of selectively coupled antenna elements and ground component portions having one or more loading structures are configured to produce a substantially omnidirectional radiation pattern substantially in the plane of the coplanar sets of selectively coupled antenna elements and ground component portions having one or more loading structures.

13. The antenna apparatus of claim 11, wherein each of the substantially coplanar sets of selectively coupled antenna elements and ground component portions having one or more loading structures comprise radio frequency conducting material configured to be conformally mounted to a housing containing the antenna apparatus.

14. The antenna apparatus of claim 11, wherein each of the substantially coplanar sets of selectively coupled antenna elements and ground component portions having one or more loading structures include radio frequency conducting material configured to be conformally mounted to the outside of a substrate housing.

15. The antenna apparatus of claim 11, wherein each of the substantially coplanar sets of selectively coupled antenna elements and ground component portions having one or more loading structures are configured to be selectively coupled to a communication device.

16. The antenna apparatus of claim 15, further comprising one or more diodes for selectively coupling each of the substantially coplanar sets of selectively coupled antenna elements and ground component portions having one or more loading structures to the communication device.

17. The antenna apparatus of claim 16, wherein the diodes include a PIN diode.

18. The antenna apparatus of claim 15, wherein a combined radiation pattern resulting from two or more of the substantially coplanar modified sets of selectively coupled antenna elements and ground component portions having one or more loading structures being coupled to the communication device is more directional than the radiation pattern of a single set of a selectively coupled antenna element and a ground component portion having one or more loading structures.

19. The antenna apparatus of claim 15, wherein a combined radiation pattern resulting from two or more of the substantially coplanar sets of selectively coupled antenna elements and ground component portions having one or more loading structures being coupled to the communication device is less directional than the radiation pattern of a single set of a selectively coupled antenna element and a ground component portion having one or more loading structures.

20. The antenna apparatus of claim 15, wherein a combined radiation pattern resulting from two or more of the substantially coplanar sets of selectively coupled antenna elements and ground component portions having one or more loading structures being coupled to the communication device is offset in direction from the radiation pattern of a single set of a selectively coupled antenna element and ground component portion having one or more loading structures.

* * * * *